US006447974B1

(12) United States Patent
Chen et al.

(10) Patent No.: US 6,447,974 B1
(45) Date of Patent: Sep. 10, 2002

(54) POLYMERIZATION PROCESSES

(75) Inventors: Allan K. Chen, Oakville; George Liebermann; Tie Hwee Ng, both of Mississauga; Arthur Helbrecht, Oakville; Abdisamed Sheik-qasim, Etobicoke; David Kurceba, Hamilton, all of (CA); Chieh-Min Cheng, Rochester, NY (US); Emily L. Moore, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/896,293

(22) Filed: Jul. 2, 2001

(51) Int. Cl.[7] ..... G03G 9/093
(52) U.S. Cl. ..... 430/137.14; 430/137.17
(58) Field of Search ..... 430/137.14, 137.17

(56) References Cited

U.S. PATENT DOCUMENTS

| | | | | |
|---|---|---|---|---|
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,346,797 | A | 9/1994 | Kmiecik-Lawrynowicz et al. | 430/137 |
| 5,348,832 | A | 9/1994 | Sacripante et al. | 430/109 |
| 5,364,729 | A | 11/1994 | Kmiecik-Lawrynowicz et al. | 430/137 |
| 5,366,841 | A | 11/1994 | Patel et al. | 430/137 |
| 5,370,963 | A | 12/1994 | Patel et al. | 430/137 |
| 5,403,693 | A | 4/1995 | Patel et al. | 430/137 |
| 5,405,728 | A | 4/1995 | Hopper et al. | 430/137 |
| 5,418,108 | A | 5/1995 | Kmiecik-Lawrynowicz et al. | 430/137 |
| 5,496,676 | A | 3/1996 | Croucher et al. | 430/137 |
| 5,501,935 | A | 3/1996 | Patel et al. | 430/137 |
| 5,527,658 | A | 6/1996 | Hopper et al. | 430/137 |
| 5,585,215 | A | 12/1996 | Ong et al. | 430/107 |
| 5,650,255 | A | 7/1997 | Ng et al. | 430/137 |
| 5,650,256 | A | 7/1997 | Veregin et al. | 430/137 |
| 5,853,943 | A | 12/1998 | Cheng et al. | 430/137 |
| 5,858,601 | A | 1/1999 | Ong et al. | 430/137 |
| 5,863,698 | A | 1/1999 | Patel et al. | 430/137 |
| 5,902,710 | A | 5/1999 | Ong et al. | 430/110 |
| 5,916,725 | A | 6/1999 | Patel et al. | 430/137 |
| 5,919,595 | A | 7/1999 | Mychajlowskij et al. | 430/137 |
| 6,294,606 | B1 * | 9/2001 | Chen et al. | 430/137 |

* cited by examiner

*Primary Examiner*—John Goodrow
(74) *Attorney, Agent, or Firm*—E. O. Palazzo

(57) ABSTRACT

A process for the preparation of a latex polymer by (i) preparing or providing a water aqueous phase containing an anionic surfactant in an optional amount of less than or equal to about 20 percent by weight of the total amount of anionic surfactant used in forming the latex polymer;

(ii) preparing or providing a monomer emulsion in water which emulsion contains an anionic surfactant;

(iii) adding about 50 percent or less of said monomer emulsion to said aqueous phase to thereby initiate seed polymerization and to form a seed polymer, said aqueous phase containing a free radical initiator; and (iv) adding the remaining percent of said monomer emulsion to the composition of (iii) and heating to complete an emulsion polymerization thus forming a latex polymer.

41 Claims, No Drawings

POLYMERIZATION PROCESSES

BACKGROUND OF THE INVENTION

The invention relates to semicontinuous emulsion polymerization process and to a method for preparing toner particles wherein, for example, the latex selected is formed by emulsion polymerization in the presence of an anionic surfactant. The aforementioned toners are especially useful for imaging processes, especially xerographic processes, which processes usually prefer high toner transfer efficiency, such as those processes with a compact machine design or those that are designed to provide high quality colored images with excellent image resolution and acceptable signal-to-noise ratio, and excellent image uniformity.

Embodiments of the present invention relate to a semicontinuous emulsion polymerization process for the preparation of toner compositions, and wherein the latex selected for such processes can be generated in the absence of a nonionic surfactant, and more specifically, wherein there is selected an anionic surfactant partitioning process, that is for example, wherein a part of the anionic surfactant is added at one stage of the process and the remaining part of the surfactant is added at a second stage in the process thereby permitting, for example, excellent latex particle sizes of from about 150 to about 300 nanometers without increasing or decreasing the total amount of surfactant utilized. For example, when too much initial stage surfactant partitioning, for example more than about 20 percent of the total anionic surfactant to be used in the process, is selected there may result small particle sizes of less than about 150 nanometers resulting in high viscosity for the toner aggregated slurry of more than 300 cps at temperatures between 35° C. to 45° C. measured at a shear-rate 100 $s^{-1}$ which can result in a longer toner aggregation cycle time, for example 2 to 3 hours or a process with significant reactor fouling, poor toner particle size distribution (GSD>1.25 by volume), coarse toner particles and the like. When too little initial stage surfactant is added, for example, less than 1 percent of the total anionic surfactant to be used in the process, there may result too large a particle size of more than 300 nanometers causing low viscosity in the toner process, for example a toner aggregated slurry viscosity of less than 50 cps at temperatures between 35° C. to 450° C. measured at shear rate 100 $s^{-1}$ which may cause poor toner particle size distribution, toner fines and poor particle size control. Although these disadvantages are noted, the processes of the present invention can encompass such disadvantages depending, for example, on the particle sizes desired, viscosity desired, and other characteristics.

More specifically, in embodiments the present invention relates to anionic surfactant partitioning methods to achieve, for example, optimum polymer latex size of, for example, about 150 to about 300 nanometers, and more specifically, from about 175 to about 225 nanometers particle diameter size without using any nonionic surfactant, and wherein the anionic surfactant selected is added, for example, in an amount of from about 1 to about 20 percent by weight to the aqueous phase in the reactor and the remainder of the anionic surfactant is used to generate the monomer emulsion.

PRIOR ART

It is known to form toners by aggregating a colorant with a latex polymer. In U.S. Pat. No. 5,853,943, the disclosure of which is totally incorporated herein by reference, there is illustrated a semicontinuous emulsion polymerization process for preparing a latex by first forming a seed polymer.

In known emulsion polymerization processes, surfactant emulsifiers are used to stabilize the emulsion during emulsion polymerization. Generally, the surfactants used include both ionic and nonionic surfactants. However, these surfactants which can be an advantage for emulsion polymerization can be detrimental to the functional properties or processing of the final toners. In particular, the presence of certain surfactants, particularly nonionic surfactants, can contribute to undesirable final toner characteristics, such as sensitivity to relative humidity, low tribo charge, high dielectric loss, aging and poor toner flow.

A number of emulsion aggregation processes possess disadvantages in that, for example, the toner tribo charge depends primarily on environmental changes. Thus, for example, toner tribo charge degradation can be observed with these processes in an environment of high temperature and high humidity (>30° C. and >80 percent relative humidity). The tribo charge of the emulsion aggregation toner particles at high relative humidity can generally be controlled by avoiding the presence of surfactants, particularly nonionic surfactants, on the particle surface. Another disadvantage of a number of prior art emulsion processes is that the adhesive properties between the resulting toner particles and the substrate is poor at high relative humidity in view of the presence of nonionic surfactants on the toner particles. Thus, surfactants used in emulsion aggregation emulsion polymerization processes should be removed from the toner particles by washing to obtain stable triboelectric properties. However, nonionic surfactants are known to form hydrogen-bonded complexes with carboxylic acids and are thus difficult to remove from the surface of, for example, acrylic acid-containing particles. In addition, often the removal of these surfactants, particularly nonionic surfactants, from the emulsion aggregation particles is tedious and resource consuming, since surfactant removal is an equilibrium process and requires acceleration to be cost effective.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,919,595; 5,916,725; 5,902,710; 5,863,698 and 5,858,601.

SUMMARY OF THE INVENTION

Aspects of the present invention relate to a process for the preparation of a latex polymer comprising (i) preparing or providing an aqueous phase containing an anionic surfactant;

(ii) preparing or providing a monomer emulsion in water which emulsion contains an anionic surfactant;

(iii) adding about 50 percent or less of the monomer emulsion to the aqueous phase to thereby initiate seed polymerization and to form a seed polymer, the aqueous phase further containing a free radical initiator; and (iv) adding the remaining amount of the monomer emulsion to (iii) and heating to complete an emulsion polymerization and wherein there is generated the polymer; a process wherein the process is free of nonionic surfactant; a process wherein the anionic surfactant is a diphenyloxide disulfonate; a process wherein the free radical initiator is added to the aqueous phase before, during or simultaneously with the monomer emulsion; a process wherein the free radical initiator is contained in the monomer emulsion when it is added to the aqueous phase; a process wherein the free radical initiator is added over a period of from about 5 to about 24 minutes; a process wherein the free radical initiator contained in the aqueous phase during the seed polymerization is present in an amount of from about 5 to about 100 percent by weight; a process wherein the free radical initiator is a persulfate initiator; a process wherein the monomer emulsion further comprises a chain transfer agent; a process wherein the surfactant in (i) is present in an amount present in an amount of from about 0.1 to about 3 percent of the total amount used in forming the latex, and the portion of the monomer emulsion added in (iii) is selected in an amount of about 0.5 to about 3 percent by weight of the monomer emulsion; a process wherein about 0.1 to about 50 percent of the remainder of the monomer emulsion is added to (iv), and wherein the total amount of the monomer emulsion is about 100 percent; a process wherein the monomers used to prepare an emulsion (i) comprise more than three monomers; a process wherein the monomer emulsion in (ii) is selected in an amount of from about 80 to about 99 percent; a process and wherein a toner is generated by aggregating a colorant with the formed latex polymer; and coalescing or fusing the aggregates to form toner particles; a process wherein the colorant is a dispersion containing a surfactant; a process further comprising adding a flocculent to the latex polymer before the latex polymer is aggregated with the colorant; a process wherein the aggregates further comprise a wax; a process wherein the aggregates further comprise a charge control agent; a process wherein the colorant is a pigment; a process wherein the colorant is a dye; a process wherein the latex polymer is a methacrylate, an acrylate, a styrene methacrylate, or a styrene acrylate; a process wherein the latex polymer is a styrene/butylacrylate/carboxyethylacrylate, optionally with from about 70 to about 80 weight percent of styrene, optionally about 30 percent of butylacrylate, and optionally about 1 to about 5 percent carboxyethylacrylate; a process wherein heating is at a temperature of from about 70° C. to about 80°C.; a process wherein the anionic surfactant is present in an amount of from about 1 to about 10 weight percent, and the adding of (iii) of about 50 percent or less is from about 0.25 to about 30 weight percent, and the adding of the remaining (iv) is from about 75 to about 99 weight percent; a process for the preparation of toner comprising mixing an aqueous phase containing an anionic surfactant and an initiator with a monomer emulsion, and wherein an effective amount of the monomer emulsion is present; heating; mixing colorant with the formed latex polymer and coalescing; a process wherein the monomer emulsion is added in an amount of from about 0.25 to about 30 weight percent followed by the addition of from about 70 to about 99 weight percent of the monomer emulsion, and wherein the total of the monomer emulsion is about 100 percent by weight; a process wherein the aggregating is accomplished by heating below about the glass transition temperature of the polymer, and wherein the coalescing is accomplished by heating about above the polymer glass transition temperature; a process for the preparation of toner comprising mixing a colorant dispersion, an aqueous monomer emulsion, and an aqueous phase emulsion, and wherein the monomer and aqueous emulsion contains an anionic surfactant, wherein the anionic surfactant is optionally present in an amount of from about 70 to about 99 weight percent in the monomer emulsion, wherein the anionic surfactant is optionally present in an amount of from about 30 to about 1 weight percent in the aqueous emulsion and thereafter aggregating and coalescing by heating; a process wherein the anionic surfactant is sodium dodecylsulfate (SDS), sodium dodecylbenzene sulfonate (SDBS), sodium dodecylnaphthalene sulfate, dialkyl benzenealkyl sulfates or sulfonates, abitic acid, or sodium tetrapropyl diphenyloxide disulfonate; a process wherein the surfactant is DOWFAX 2A1™, a sodium tetrapropyl diphenyloxide disulfonate; a process wherein a free radical initiator is added; a process wherein the latex polymer is generated from the polymerization of monomer to provide a latex emulsion with submicron resin particles in the size range of from about 150 to about 300 nanometers in volume average diameter, and wherein the latex contains an ionic surfactant, a water soluble initiator, a crosslinking agent and a chain transfer agent; adding anionic surfactant to retain the size of the toner aggregates formed; mixing with colorant; thereafter coalescing or fusing the aggregates by heating; and isolating, washing, and drying the toner; a process wherein the aggregation temperature is from about 45° C. to about 55° C., and wherein the coalescence or fusion temperature is from about 85° C. to about 95° C.; a process wherein the latex resin, or polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the colorant is carbon black, cyan, yellow, magenta, or mixtures thereof; the toner particles isolated are from about 2 to about 25 microns in volume average diameter, and wherein there is added to the surface of the formed toner metal salts, metal salts of fatty acids, silicas, metal oxides, or mixtures thereof, each in an amount of from about 0.1 to about 10 weight percent of the obtained toner particles; a process wherein the free radical initiator is ammonium persulfate, potassium persulfate, sodium persulfate, ammonium persulfite, potassium persulfite, sodium persulfite, ammonium bisulfate, sodium bisulfate, 1,1'-azobis(1-methyl butyronitrile-3-sodium sulfonate), or 4,4'-azobis(4-cyanovaleric acid); a process wherein the chain transfer agent is dodecanethiol, butanethiol, isooctyl-3-mercaptopropionate (IOMP), 2-methyl-5-t-butylthiophenol, carbon tetrachloride, or carbon tetrabromide; a process wherein the aggregation temperature is from about 45° C. to about 55° C., and wherein the coalescence or fusion temperature is from about 85° C. to about 95° C.; a toner obtained by the mixing of a colorant and the polymer formed by the process of the invention followed by aggregation and coalescence; a toner wherein the aggregation and the coalescence are accomplished respectfully by heating below the glass transition temperature of the polymer and heating above the transition temperature of the polymer, followed by cooling; and a process wherein the aqueous phase surfactant is selected in an amount of from about 1 to about 20 weight percent and methods for preparing latex polymers by an emulsion polymerization process that in embodiments avoids the use of nonionic surfactants and optimizes the use of anionic surfactants by, for example, partitioning the total anionic surfactant amount added to the aqueous phase in the reactor and the monomer emulsion in the feed to thereby, for example, control the latex resin particle size, for example about 150 nanometers to about 300 nanometers, and more specifically, from about 175 to about 250 nanometers. Furthermore, the process of the present invention can provide in embodiments a nonionic surfactant-free latex emulsion with high resin solids loading, such as about 40 weight percent, and wherein there can be selected latex resin particle sizes with a particle size distribution of less than about <1.15, and allowing the achieving mean latex sizes ranging from about 150 to about 300 nanometers by using (anionic surfactant) partitioning in a nonionic surfactant-free semicontinuous emulsion polymerization process.

The process of the present invention comprises in embodiments forming an aqueous phase containing anionic surfactant in an amount from about 1 to about 20 percent, and more specifically, from about 5 to about 10 percent by weight of the total amount of anionic surfactant used in forming the latex polymer, and wherein the aqueous phase is nonionic-surfactant free. By partitioning and optimizing the amount of anionic surfactant in the initial aqueous phase, toner with improved electrical and particle size properties may be provided. Also, the present invention relates to processes for the preparation of latexes containing, for example, water and polymer, wherein an anionic surfactant is added in an amount of from about 80 to about 99 percent, or from about 90 to about 95 percent to the monomer emulsion, and wherein the same anionic surfactant is added to the reactor aqueous phase in an amount of from about 1 to about 20 weight percent, and preferably from about 5 to about 10 weight percent. The process of the present invention includes the preparation of nonionic surfactant free polymer latexes wherein a portion, such as about 1 to about 20 parts of total anionic surfactant is added to the aqueous phase in the reactor, which phase is comprised of water, and wherein the water is present in an amount of from about 99.3 to about 99.9 weight percent, or parts; followed by adding the remaining amount of anionic surfactant, such as from about 80 to about 99 parts to the monomer emulsion, and wherein the total of anionic surfactant is about 100 parts, or 100 percent; wherein a small portion, such as 0.1 percent to 10 percent from the monomer emulsion is charged into the reactor as a seed; subsequently initiating seed polymerization by the addition of an aqueous solution of free radical initiator of ammonium persulfate in an amount of 15 percent and water inan amount of 85 percen, and wherein there can be generated a polymer with ionic end groups, such as sulfate ions and, for example, wherein the ionic end groups are selected, for example, from the group consisting of a carboxylic acid, a sulfonic acid, a sulfophenyl, a carboxyphenyl, a sulfonamide, or the derivatives thereof and mixtures thereof, wherein the amount of ionic end groups is from about 0.01 to about 1 percent, or from about 0.02 to about 0.5 percent, based on moles of monomer used thereby permitting, for example, a stable seed emulsion containing, for example, a 15 nanometers to 100 nanometers resin particle size latex as measured by Coulter Counter, and thereafter adding the remainder slowly, for example from about 90 percent to about 99.9 percent or parts, of the above monomer emulsion to the reactor and heating to, for example, from about 65° C. to about 95° C. resulting in a latex composition comprised of polymer in an amount of from about 35 percent to about 45 percent, and water in an amount of from about 55 to about 65 weight percent.

More specifically, in embodiments the present invention comprises processes for the preparation of latexes containing, for example, about 30 to about 35 percent water, and wherein an anionic surfactant is added to the water in an amount of from about 80 to about 99 percent, and preferably from about 90 to about 95 percent of total anionic surfactant used to the monomer mixture thereby forming a monomer emulsion containing about 67 percent monomer, 1.2 percent chain transfer agent, 0.2 percent crosslinking agent, 0.6 percent anionic surfactant and 31 percent water, and wherein the same anionic surfactant is added to the reactor aqueous phase containing, for example, about 99.92 percent water and 0.08 percent anionic.

The process of the present invention further comprises preparing an emulsion of monomers in water separate from the aqueous phase. The monomer emulsion comprises anionic surfactant and is nonionic surfactant-free. To form the emulsion, monomer and anionic surfactant are generally added to water and agitated to form an emulsion. The monomer emulsion may also contain a free radical initiator. After the monomer emulsion has been formed, a portion of no more than 25 percent by weight of the monomer emulsion and a free radical initiator is added to the aqueous phase and mixed to initiate seed polymerization at the desired reaction temperature. In this process, the initiator is a free radical initiator that attaches to the seed polymer to form ionic, hydrophilic end groups on the polymer. The free radical initiator may be added separately before, during or at the same time as the monomer emulsion or as part of the monomer emulsion. Subsequent to the formation of seed particles, additional monomer from the monomer emulsion is added to the composition, and the polymerization is continued at a prescribed temperature for a desired period of time to complete polymerization thus forming a latex polymer. During this process, about 0.5 to. about 1 part per hundred of additional initiator may also be added. When added, this initiator is preferably a free radical initiator. After forming the latex polymer, the latex may then be aggregated with a colorant, preferably in the form of a colorant dispersion, to form aggregate particles that are then coalesced or fused to form toner particles.

Nonionic surfactant may be present in or added to the colorant dispersion. In particular, using the nonionic surfactant-free latex in emulsion aggregation to provide a toner will generally enable at least a 50 percent surfactant reduction since the bulk of the surfactant in typical toners originates from the latex rather than from the colorant dispersion and a substantial amount of the surfactant used in forming the latex is typically a nonionic surfactant.

DETAILED DESCRIPTION OF EMBODIMENTS

One or more monomers, that is for example, from 1 to about 10, and more specifically, from 1 to about 5 monomers may be used to form the latex polymer. Any suitable monomers may be used. Monomers particularly useful in the nonionic surfactant-free process of the present invention include, but are not limited to, acrylic and methacrylic esters, styrene, vinyl esters of aliphatic acids, ethylenically unsaturated carboxylic acids and known crosslinking agents. Suitable ethylenically unsaturated carboxylic acids can be acrylic acid, methacrylic acid, itaconic acid, maleic acid, fumaric acid, 2-carboxyethyl acrylate (βCEA), and the like. Suitable crosslinking agents can be divinyl benzene, divinyl toluene, diacrylates or dimethacrylates, or the like. Preferably, more than one monomer is used. In particular, the monomers preferably include styrene, n-butyl acrylate and/or βCEA, β-carboxyethyl acrylate in the composition of 77.5 percent styrene, 22.5 percent n-butyl acrylate and 3 pph β-carboxyethyl acrylate.

The monomers are mixed with water and an anionic surfactant to form an emulsion. The emulsification is generally accomplished at a temperature of about 5° C. to about 40° C. However, the emulsion may also be accomplished at a temperature of from about 5° C. to about 65° C. To form an emulsion, the mixture is generally agitated using an appropriate mixing device, such as a vessel with an agitator, with one or multiple impellers, a vessel containing a high speed agitator, such as a homogenizer, or a vessel equipped with an external loop containing an in-line mixing device. The mixing speed of, for example, from about 5 to about 6,000 rpm can be selected to form an emulsion in embodiments is determined by the type of device used. The time required to form an emulsion is generally less if the mixture is agitated at a higher speed.

The anionic surfactant used in forming the monomer emulsion may be any anionic surfactant which will provide the desired emulsification and latex, and which will not substantially affect the toner functional properties. Anionic surfactants that may be used include, but are not limited to, diphenyloxide disulfonates, alkylbezene sulfonates, alkyl naphthalene sulfonates and sulfates, sodium dodecylbenzylsulfonate, sodium decylsulfonate and the like, or mixtures thereof. The preferred class of anionic surfactants are the diphenyloxide disulfonates, as it was found, in embodiments, that they offer the best combination of properties for the latex production, as well as for the toner preparation and properties. In a preferred embodiment of the invention, the surfactants used are commercially available diphenoxide disulfonates, such as the DOWFAX™ series available from Dow Chemical. In specific embodiments, the amount of anionic surfactant in the monomer emulsion is more than 80 percent by weight, more specifically, more than 90 to 95 percent by weight, of the total amount of anionic surfactant used in forming the latex polymer. The total amount of anionic surfactant used in forming the latex polymer may be from about 0.5 and about 10 percent by weight, or from about 1 to about 4 percent by weight of the total amount of monomer used in forming the latex polymer.

In addition, a chain transfer agent can be added to the monomer emulsion to control the molecular weight properties of the formed polymer. Chain transfer agents that may be selected include, but are not limited to, dodecanethiol, butanethiol, isooctyl-3-mercaptopropionate (IOMP), 2-methyl-5-t-butylthiophenol, carbon tetrachloride, or carbon tetrabromide, and the like. Chain transfer agents may be used in any effective amount, such as from about 0.1 to about 10 percent by weight of the monomer selected for the monomer emulsion.

To form the seed polymer, about, for example, 0.25 percent to 25 percent by weight of the monomer emulsion can be added to the aqueous phase in the reactor. The aqueous phase usually contains no more than about 1 to about 20 percent by weight of the total amount of anionic surfactant used in forming the latex polymer. More specifically, the aqueous phase contains from about 5 to about 10 percent by weight of the total amount of the anionic surfactant used in forming the latex polymer. In embodiments, the aqueous phase contains less than about 8 percent by weight of the total amount of anionic surfactant used in forming the latex polymer. Numerous anionic surfactants, including those recited herein, may be included in the aqueous phase and the anionic surfactant for the aqueous phase may be the same or different from the anionic surfactant used in forming the monomer emulsion.

The polymerization initiator, optionally mixed with the monomer emulsion, or added separately to the aqueous phase to form seed polymers, is a free radical initiator that attaches to the polymer forming ionic, hydrophilic end groups on the polymer. The presence of these ionic, hydrophilic end groups on the polymer imparts stability to the latex, i.e. the 150 to 300 nanometer diameter latex particles, do not agglomerate but remain suspended. The stability results, it is believed, from the electrostatic repulsion of the charged groups on the latex particles with respect to those on the other particles. Suitable initiators include, but are not limited to, ammonium persulfate, potassium persulfate, sodium persulfate, ammonium persulfite, potassium persulfite, sodium persulfite, ammonium bisulfate, sodium bisulfate, 1,1'-azobis(1-methylbutyronitrile-3-sodium sulfonate), or 4,4'-azobis(4-cyanovaleric acid). Preferably, the initiator is a persulfate initiator such as ammonium persulfate, potassium persulfate, sodium persulfate and the like. The initiator is generally added as part of an initiator solution in water. The amount of initiator used to form the latex polymer is generally from about 0.1 to about 10 percent by weight of the monomer to be polymerized. From about 5 to about 100 percent by weight, and more specifically, from about 30 to about 100 percent by weight of initiator is added during the seed polymerization stage.

In forming the seed polymer, the emulsion polymerization is generally conducted at a temperature of from about 35° C. to about 150° C., and more specifically, from about 50° C. to about 95° C. The initiator is generally added to the emulsion fairly slowly to maintain the stability of the system. For example, the initiator can be added over the course of from about 2 to about 20 minutes, and more specifically, over the course of at least about 10 minutes.

The about 75 percent to 99.75 percent of the monomer emulsion that remains is then added to the seed polymer to complete the polymerization. The emulsion polymerization is generally conducted at a temperature of from about 35° C. to about 150° C., and more specifically, from about 50° C. to about 95° C. The additional monomer emulsion is generally fed to the composition at an effective time period of, for example, 0.5 to about 8 hours, more specifically, about 2 to about 6 hours.

In addition, further initiator (up to 70 percent of the total) may or may not be added after the seed polymerization. If additional initiator is added during this phase of the reaction, it may or may not be the same initiator added to form the seed polymer. Initiators useful during this aspect of the process include, but are not limited to, hydrogen peroxide, t-butyl hydroperoxide, cumene hydroperoxide, paramethane hydroperoxide, benzoyl peroxide, tert-butyl peroxide, cumyl peroxide, 2,2'-azobisisobutyronitrile, 2,2'-azobis(2-methylbutyronitrile), 2,2'-azobis(2-amidinopropane) dihydrochloride, 2,2'-azobisisobutyl amide dihydrate, 2,2'-azobis[2-(2-imidazolin-2-yl)propane] dihydrochloride, and 2,2'-azobis[2-(5-methyl-2-imidazolin-2-yl)propane]dihydrochloride.

Illustrative examples of latex polymers that may be formed by the process of the present invention include, but are not limited to, known polymers such as poly(styrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), poly(styrene-butyl acrylate-2-carboxyethyl acrylate), poly (styrene-butadiene-2-carboxyethyl acrylate), poly(styrene-isoprene-2-carboxyethyl acrylate), poly(styrene-butyl methacrylate-2-carboxyethyl acrylate), poly(butyl methacrylate-butyl acrylate-2-carboxyethyl acrylate), poly (butyl methacrylate-2-carboxyethyl acrylate), poly(styrene-butyl acrylate-acrylonitrile-2-carboxyethyl acrylate), poly (acrylonitrile-butyl acrylate-2-carboxyethyl acrylate), branched/partially crosslinked copolymers thereof, and the like. Monomers used to achieve crosslinking and branching may include divinyl benzene, decanediol diacrylate, hexanediol diacrylate, decanediol dimethacrylate, and hexanediol dimethacrylate.

In specific embodiments, the present invention is directed to processes for the preparation of toner that comprise blending a colorant, more specifically, a colorant dispersion, more specifically containing a pigment, such as carbon black, cyan, magenta, yellow, green, blue, brown, violet, red, and more specifically, phthalocyanine, quinacridone or RHODAMINE B™ type, with a latex polymer prepared as illustrated herein and optionally with a flocculent and/or charge additives and/or other additives; heating the resulting mixture at a temperature below the Tg of the latex polymer, preferably from about 25° C. to about 1 ° C. below the Tg of the latex polymer, for an effective length of time of, for example, about 0.5 hour to about 2 hours, to form toner sized aggregates; subsequently heating the aggregate suspension at a temperature at or above the Tg of the latex polymer, for example from about 60° C. to about 120° C., to effect coalescence or fusion, thereby providing toner particles; and isolating the toner product, such as by filtration, thereafter optionally washing and drying the toner particles, such as in an oven, fluid bed dryer, freeze dryer, or spray dryer.

The latex polymer is generally present in the toner compositions in various effective amounts, such as from about 75 weight percent to about 98 weight percent of the toner, and the latex polymer size suitable for the processes of the present invention can be, for example, of from about 150 nanometers to 300 nanometers in volume average diameter as measured by the Brookhaven nanosize particle analyzer. Other sizes and effective amounts of latex polymer may be selected in embodiments.

Colorants include pigments, dyes, and mixtures of pigments with dyes, and the like. The colorant is generally present in the toner in an effective amount of, for example, from about 1 to about 15 percent by weight of toner, and preferably in an amount of from about 3 to about 10 percent by weight of the toner.

Illustrative examples of colorants, such as pigments, that may be used in the processes of the present invention include, but are not limited to, carbon black, such as REGAL 330®; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610 ™; Northern Pigments magnetites, NP-604 ™, NP-608 ™; Magnox magnetites TMB-100™, or TMB-104™; and the like. Colored pigments or dyes, including cyan, magenta, yellow, red, green, brown, blue and/or mixtures thereof, may also be used. Generally, cyan, magenta, or yellow pigments or dyes, or mixtures thereof, are used.

Specific examples of pigments include, but are not limited to, phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1 ™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

The flocculent can function as a coagulant to provide an opposite charge to the latex, for example, thus if the coagulant is positively charged and the latex is negatively charged the flocculent may be used in effective amounts of, for example, from about 0.01 percent to about 10 percent by weight of the toner. Flocculants that may be used include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL™ and ALKAQUA™ available from Alkaril Chemical Company, SANIZOL™ (benzalkonium chloride), available from Kao Chemicals, and the like.

Charge additives may also be added during, for example, the toner aggregation in suitable effective amounts of, for example, from 0.1 to 5 weight percent by weight of the toner. Suitable charge additives include, but are not limited to, alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Other additives that may be added during the toner aggregation include, but are not limited to, waxes, which may act as a releasing agent. Waxes that may be used include polyethylene waxes, polypropylene waxes and other know suitable waxes in amounts, for example, of from about 1 to about 15 weight percent.

The following Examples illustrate specific embodiments of the present invention.

(1) 300 Gallon Nonionic Surfactant-free Latex Emulsion Polymerization with Anionic Surfactant Partitioning Ratio=6 Percent DOWFAX™ in the Reactor/94 Percent DOWFAX™ in the Monomers Emulsion An nonionic surfactant-free latex (EA12–46) comprised of styrenein-butyl acrylate/β-carboxy ethyl acrylate copolymer of 75:22:3 composition, 1.71 pph dodecanethiol (chain transfer agent), 0.35 pph branching agent (A-DOD, decanediol diacrylate) and 1.5 percent of ammonium persulfate initiator was synthesized by semicontinuous emulsion polymerization process as follows. In a 300 gallon jacketed stainless steel reactor with double flight impellers (a four pitched-blade impeller each) set at 35 rpm, 387 kilograms of deionized water with 521 grams of DOWFAX 2A1 ™, which is sodium tetrapropyl diphenoxide disulfonate, (6 percent of the total surfactant) were charged while the temperature was raised from room temperature to 75° C. A monomer emulsion was prepared by mixing a monomer mixture (315.7 kilograms of styrene, 91.66 kilograms of n-butyl acrylate, 12.21 kilograms of 2-carboxyethyl acrylate (β-CEA), 1.426 kilograms of decanediol diacrylate (A-DOD) and 2.648 kilograms of 1-dodecanethiol) with 193 kilograms of deionized water plus 8.156 kilograms of DOWFAX 2A1 ™ (94 percent of the total surfactant) at room temperature, about 25° C. throughout the Examples, for 30 minutes. This was accomplished by mixing at high, 50 RPM speeds in a 150 gallon Pope tank. 6.3 Kilograms of seed were pumped from the monomer emulsion and into a 20 gallon Pope tank and was later charged in the reactor at 75° C. An initiator solution prepared from 6.11 kilograms of ammonium persulfate in 30.2 kilograms of deionized water was added over 20 minutes after the seed emulsion addition. The reactor was stirred at 48 rpm for an additional 20 minutes to allow seed particle formation at 75° C. 50 Percent of the remaining monomer emulsion was fed into the reactor over 90 minutes. Monomer emulsion feeding was stopped and there were added 4.48 kilograms of 1-dodecanethiol (DDT) to the remaining emulsion in the 150 gallon Pope tank. The Pope tank was mixed for 5 minutes before feeding was resumed. At the end of the monomer feed, the emulsion was post-heated at 75° C. for 180 minutes, then cooled to 25° C. The reaction system was deoxygenated by passing a stream of nitrogen through it during the reaction. A latex with a particle size of 254 nanometers was obtained. The final latex contained 42 weight percent bulk styrene-butyl acrylate-carboxy ethyl acrylate resin, 57 weight percent water, 0.4 weight percent anionic surfactant and 0.6 weight percent of a salt species. The resin possessed an $M_w$ of 36,200, an $M_n$ of 10,900 kilograms, both as measured by gel permeation chromatography, and an onset Tg of 51.1° C. as measured by differential scanning calorimeter.

(2) 300 Gallon Nonionic Surfactant-free Latex Emulsion Polymerization with Anionic Surfactant Partitioning Ratio=7 Percent DOWFAX™ in the Reactor/93 Percent DOWFAX™ in the Monomers Emulsion An nonionic surfactant-free latex (EA12–48) comprised of styrene/n-butyl acrylate/p-carboxy ethyl acrylate copolymer of 75:22:3 composition using 1.71 pph dodecanethiol (chain transfer agent), 0.35 pph branching agent (A-DOD, decanediol diacrylate) and 1.5 percent of ammonium persulfate initiator was synthesized by a semicontinuous emulsion polymerization process. In a 300 gallon jacketed stainless steel reactor with double flight impellers (a four pitched-blade impeller each) set at 35 rpm, 387 kilograms of deionized water with 521 grams of DOWFAX 2A1™ which is sodium tetrapropyl diphenoxide disulfonate (7 percent of the total surfactant) were charged while the temperature was raised from room temperature to 75° C. A monomer emulsion was prepared by mixing a monomer mixture (315.7 kilograms of styrene, 91.66 kilograms of n-butyl acrylate, 12.21 kilograms of 2-carboxyethyl acrylate (β-CEA), 1.426 kilograms of A-DOD and 4.48 kilograms of 1-dodecanethiol) with 193 kilograms of deionized water and 8.069 kilograms of DOWFAX 2A1™ (93 percent of the total surfactant) at room temperature for 30 minutes in a 150 gallon Pope tank. 6.3 Kilograms of seed were pumped from the monomer emulsion into a 20 gallon Pope tank and was later charged into the reactor at 75° C. An initiator solution prepared from 6.11 kilograms of ammonium persulfate in 30.2 kilograms of deionized water was added over 20 minutes after the seed emulsion addition. The reactor was stirred at 48 rpm for an additional 20 minutes to allow seed particle formation at 75° C. The remaining monomer emulsion was fed into the reactor over 90 minutes. Monomer emulsion feeding was stopped and 2.486 kilograms of 1-dodecanethiol (DDT) were added to the remaining emulsion in the 150 gallon Pope tank which was mixed for a further 5 minutes before feeding resumed. At the end of the monomer feed, the emulsion was post-heated at 75° C. for 180 minutes, then cooled to 25° C. The reaction system was deoxygenated by passing a stream of nitrogen through it during the reaction. A latex resin containing 42 solids of 42 weight percent styrene-butyl acrylate-carboxy ethylacrylate resin, 57 weight percent water, 0.4 weight percent anionic surfactant, 0.6 percent of a salt species with a resin particle size of 207 nanometers was obtained. The latex resin possessed an $M_w$ of 31,000, an $M_n$ 10,800, and an onset Tg of 51.5° C.

(3) 300 Gallon Nonionic Surfactant-free Latex Emulsion Polymerization with Anionic Surfactant Partitioning Ratio=5 Percent DOWFAX™ in the Reactor/95 Percent DOWFAX™ in the Monomers Emulsion An nonionic surfactant-free latex (EA12–43) comprised of styrene/n-butyl acrylate/β-CEA copolymer of 77.5:22.5:3 composition using 1.75 pph dodecanethiol (chain transfer agent), 0.35 pph branching agent (A-DOD, decanediol diacrylate) and 1.5 percent of ammonium persulfate initiator was synthesized by semicontinuous emulsion polymerization process. In a 300 gallon jacketed stainless steel reactor with double flight impellers (a four pitched-blade impeller each) set at 35 rpm, 387 kilograms of deionized water with 434 grams of DOWFAX 2A1 ™ (5 percent of the total surfactant) were charged while the temperature was raised to 75° C. A monomer emulsion was prepared by mixing a monomer mixture (315.7 kilograms of styrene, 91.66 kilograms of n-butyl acrylate, 12.21 kilograms of 2-carboxyethyl acrylate (β-CEA), 1.426 kilograms of A-DOD and 2.85 kilograms of 1-dodecanethiol) with 193 kilograms of deionized water plus 8.242 kilograms of DOWFAX 2A1™ (95 percent of the total surfactant) at room temperature, about 25° C. throughout, for 30 minutes. This was accomplished by mixing at high speed in a 150 gallon Pope tank. 6.3 Kilograms of seed were taken from the monomer emulsion and pumped into a 20 gallon Pope tank and were later charged into the reactor at 75° C. An initiator solution prepared from 6.11 kilograms of ammonium persulfate in 30.2 kilograms of deionized water was added over 20 minutes after the seed emulsion addition. The reactor was stirred for an additional 20 minutes to allow seed particle formation at 75° C. 50 Percent of the remaining monomer emulsion was fed into the reactor over 90 minutes. At this point, the monomer emulsion feed was stopped and 4.279 kilograms of 1-dodecanethiol (DDT) were added to the remaining emulsion in the 150 gallon Pope tank. The Pope tank was mixed for a further 5 minutes before feeding resumed. At the end of the monomer feed, the emulsion was post-heated at 75° C. for 180 minutes, then cooled to 25° C. The reaction system was deoxygenated by passing a stream of nitrogen through it during the reaction. A latex containing 42 weight percent styrene-butyl acrylate-carboxy ethyl acrylate resin, 57 weight percent water, 0.4 weight percent anionic surfactant, and 0.6 weight percent of a salt species with a resin particle size of 304 nanometers was obtained. The latex resin had an $M_w$ of 51,700 kilograms, an $M_n$ of 10,600 kilograms and an onset Tg of 50.6° C.

Toner Particle Preparation from Semicontinuous Nonionic Surfactant-free Latex by Aqgregation/Coalescence Process using Polyaluminum Chloride (PAC) as Flocculant Toner with colorant particle size distribution refers to the geometric standard deviation (GSD) which is a computed as:

$$\mathrm{GDS} = \frac{D84 * D16}{D50^2}$$

where D84, D16, and D50 are the diameter of the $84^{th}$, $16^{th}$, and $50^{th}$ percentile of particle size as determined by Coulter Counter measurement. Where the percentiles are determined by count number, this equation provides the number GSD or GSDn. Where the percentiles are weighted by particle volume, the volume GSD or GSDv is given. Excellent toner particle size distribution can be a GSDv<1.25 and GSDn<1.30. Excellent toner particle size distributions resulting from using optimum latex particle size (about 150 nanometers and 300 nanometers) have been demonstrated and some of the results are shown in the following Examples.

(4) 5.5 Micron Cyan Toner Particles by PAC A/C Process

Nonionic surfactant-free latex (EA12–43) synthesized by the semicontinuous process/formulation of Example (3) above has been demonstrated in a 2 liter aggregation/coalescence process to produce toner particles with a broad GSDn. This latex has a particle diameter size of 304 nanometers.

466 Grams of deionized water (DIW) were charged into a 2 liter stainless steel reactor at room temperature. The nonionic surfactant-free latex EA12–43 (203.8 kilograms) was also charged and homogenized, while 37.16 grams of POLYWAX 725 ® were added followed by the addition of 34.74 grams of PB15:3 cyan pigment. To this homogenized latex/pigment blend, 2.45 grams of 10 percent PAC solution diluted with 22.05 grams of 0.02M nitric acid was added slowly to cause a flocculation. After the addition was completed, homogenization was continued for an additional 5 to 10 minutes until a toner slurry was achieved of less than about 2 micron resin diameter, for example about 1.5, particle size and with a minimum amount of coarse particles, for example particles above about 5 microns. The resulting creamy blend was than heated to abou°C t 45 to about 50° C. Particle growth was monitored during heating. When particle size by volume was equal to 4.7 microns, 96.7 grams of a shell latex were added slowly over 15 minutes. The resulting slurry was stirred for another about 30 to about 60 minutes, then the pH of the slurry was adjusted to 7.5 by the addition of 1 percent NaOH to "freeze" the toner particle size. After 30 minutes of stirring at the polymer aggregation temperature, the reactor temperature was raised to 95° C. and the temperature held at 95° C. for 4 to 6 hours. The toner slurry pH was then adjusted again to pH 3.5 using diluted nitric acid to permit spheroidization of the toner into spherical shaped toners. The reactor contents were then cooled to 25° C. A 14 percent solids slurry of 5.3 micron cyan particles with GSDv=1.18, GSDn=1.61 was achieved. The final toner particles produced contained a large amount of fines, for example particles less than 3 microns as indicated by GSDn=1.61. This large GSDn indicates that the toner particle size distribution was broad.

(5) 5.5 Micron Cyan Toner Particles by PAC A/C Process

A 50:50 mixture of the above nonionic surfactant-free latex EA12–46 and EA12–48 synthesized by the semicontinuous process/formulation described in Examples (1) and (2), respectively, was generated in a 2 liter aggregation/coalescence process to formulate 5.5 micron toner particles with an excellent toner particle size distribution. The latexes had particle sizes of 254 nanometers and 207 nanometers, respectively, both of which were within one optimum range of 150 to 300 nanometers. 466 Grams of DIW were charged into a 2 liter stainless steel reactor at room temperature. A 50:50 mixture of nonionic surfactant-free latex EA12–46 and EA12–48 (203.8 kilograms) was also charged and homogenized, while 37.16 grams of POLYWAX $72_5$™ was added followed by the addition of 34.74 grams of PB15:3 cyan pigment. To this homogenized latex/pigment blend, 2.45 grams of 10 percent PAC solution diluted with 22.05 grams of 0.02M nitric acid, was added slowly to cause flocculation. After the addition was completed, homogenization was continued for any additionally 5 to 10 minutes. It was desirable to start with a toner slurry of less than 2 micron size and minimum amount of coarse particles. The creamy blend resulting was than heated to 45° C. to 50° C.

Particles growth was monitored during heating. When particle size by volume was equal to 4.7 microns, 96.7 grams of a shell latex above was added slowly over 15 minutes. The slurry was stirred for another about 30 to about 60 minutes, then the pH of the slurry was adjusted to 7.5 by the addition of 1 percent NaOH to "freeze" the toner particle size. After 30 minutes of stirring at the aggregation temperature, the reactor temperature was raised to 95° C. and held at 95° C. for 4 to 6 hours. The toner slurry pH was adjusted again to pH 3.5 using diluted nitric acid at 95° C. to spheroidize the toner into smooth, spherical toners. Then, the reactor contents were cooled down and discharged. A 14 percent solids slurry of 5.3 microns, volume average diameter throughout, cyan toner particles with GSDv=1.1 8, and a GSDn=1.22 was obtained.

| | | | Toner Particle | | | |
|---|---|---|---|---|---|---|
| Latex ID | Latex GSD | Latex Size | $D_{50}$ | GSDv | GSDn | Comments |
| Pilot Plant 300-Gal (EA12-43) | 1.11 | 304 nm | 5.3 | 1.18 | 1.61 | Too many toner fines |
| Pilot Plant 300-Gal (EA12-46/48) | 1.11 | 243 nm | 5.5 | 1.18 | 1.22 | Good toner GSDs |

EXAMPLE I

Nonionic Surfactant-Free Latex Synthesis with Controlled Anionic Surfactant Addition (1)

A nonionic surfactant-free latex comprising styrene/n-butyl acrylate/β-CEA copolymer of 77.5/22.5/3 composition was synthesized by a nonionic surfactant-free emulsion polymerization process using sodium tetrapropyl diphenoxide disulfonate (DOWFAX 2A1 ™) as the anionic surfactant, ammonium persulfate as the initiator, decanediol diacrylate (A-DOD™) as the crosslinker, and dodecanethiol as the chain transfer agent.

In a 300 gallon jacketed stainless steel reactor equipped with an agitator (two four pitched-blade impellers) set at 35 rpm, 387 kilograms of deionized water and 694 grams of DOWFAX 2A1™ were charged while the temperature was raised to 75° C. A monomer emulsion was prepared in a separate 150 gallon vessel equipped with an agitator by mixing a monomer mixture (315.70 kilograms of styrene, 91.66 kilograms of n-butyl acrylate, 12.21 kilograms of 2-carboxyethyl acrylate (β-CEA), 1.426 kilograms of decanediol diacrylate (A-DOD) and a total of 6.95 kilograms of 1-dodecanethiol with 193 kilograms of deionized water plus 7.982 kilograms of DOWFAX 2A1 ™ at room temperature for 30 minutes. 6.278 Kilograms of seed monomer emulsion were removed from the monomer emulsion agitated and pumped into the reactor which was retained at 75° C., under a nitrogen purge. After 10 minutes, an initiator solution prepared from 6.11 kilograms of ammonium persulfate in 30.20 kilograms of deionized water were added over 20minutes. Stirring was continued for an additional 20 minutes to allow seed particle formation. The remaining 99 percent monomer emulsion was fed into the reactor over 180 minutes. At the conclusion of the monomer feed, the resulting composition was post-heated at 75° C. for 180 minutes to complete the reaction, then cooled. The reaction system was deoxygenated by passing a stream of nitrogen through it during the reaction.

A latex containing 41.9 percent solids with a resin $M_w$ of 35,000, an $M_n$ of 10,400, and an onset Tg of 51.1° C. was obtained. The residual monomer (styrene and butyl acrylate) in the latex was less than about 100 ppm, and more specifically, about 85 ppm for each monomer. This latex was stable and substantially sediment-free. No sediment was observed after the latex was allowed to stand for three months.

EXAMPLE II

Nonionic Surfactant-Free Latex Synthesis with Controlled Anionic Surfactant Addition (2)

The procedure described in Example I was repeated, except the amount of DOWFAX 2A1™ used in the preparation of the aqueous phase was 434 grams, and 8.242 kilograms were selected in the preparation of the monomer emulsion, and the total amount of dodecanethiol used was 7.129 kilograms. The amount of seed monomer emulsion used was 6.3 kilograms.

A latex containing about 40 percent solids polymer of styrene/butylacrylate/2-carboxyethylacrylate 77.5/22.5/3 with an $M_w$ of 39,2000, an $M_n$ of 10,700 and an onset Tg of 51.1 5° C. was obtained. This latex which contains 40 percent of the above polymer and 60 percent water was stable and no sediment was observed after the latex was allowed to stand for two months.

COMPARATIVE EXAMPLE 1

Latex Synthesis Using an Anionic Surfactant

A latex containing a nonionic ABEX $_{2010}$™ surfactant and a styrene/butyl acrylate/acrylic acid copolymer of 77/23/1.5 composition was synthesized by an emulsion polymerization process using an anionic surfactant system for a styrene/acrylic copolymer. The surfactant system was comprised of a functional formulated surfactant/water/1,4-dioxane/ethyleneoxide (proprietary) proprietary anionic custom designed commercial product obtained from Rhodia as ABEX 2010™, which contained 30 percent active solids.

In a 5 gallon jacketed stainless steel reactor equipped with an agitator (one four pitched-blade impeller) set at 100 rpm, 7.910 kilograms of deionized water and 427.14 grams of ABEX 2010™ were charged while the temperature was raised to 80° C. A monomer emulsion was prepared in a separate 5 gallon vessel equipped with an agitator by mixing a monomer mixture of 6,577.96 grams of styrene, 1,964.85 grams of n-butyl acrylate, 128.14 grams of acrylic acid, 58.09 grams of decanediol diacrylate A-DOD, and 59.8 grams of dodecanethiol with 3,638.6 grams of deionized water and 427.14 grams of ABEX 2010 at room temperature for 30 minutes. An initiator solution prepared from 128 grams of ammonium persulfate in 640.78 grams of deionized water was added to the aqueous phase in the reactor, under nitrogen purge, at 80° C. over 37 minutes. The monomer emulsion was fed into the reactor over 180 minutes while maintaining the reactor temperature at 80° C. At the conclusion of the monomer feed, the composition was post-heated at 80° C. for 120 minutes, then cooled. The reactor system was deoxygenated by passing a stream of nitrogen through it during the reaction.

A latex containing about 40 percent solids with a resin $M_w$ of 75,700, an $M_n$ of 14,300 and an onset Tg of 53.5° C. was obtained. No sediment was observed after the latex was allowed to stand for three months.

COMPARATIVE EXAMPLE 2

Latex Synthesis Using a Nonionic Surfactant and Anionic Surfactant

A latex containing a 70 percent active polyoxyethylene nonyl phenyl ether (ANTAROX CA89™ from Rhodia) nonionic and anionic surfactant comprising a styrene/butyl acrylate/acrylic acid copolymer of 80/20/1.5 composition was synthesized by an emulsion polymerization process using both an anionic and nonionic surfactant. The anionic surfactant was a 20 percent active sodium dodecylbenzenesulfonate (NEOGEN RK™ from Kao) while the nonionic surfactant was a 70 percent active polyoxyethylene nonyl phenyl ether (ANTAROX CA89™ from Rhodia).

In a 300 gallon jacketed stainless steel reactor equipped with an agitator (two four pitched-blade impellers) set at 70 rpm, 495.4 kilograms of deionized water, 8.11 kilograms of NEOGEN RK™ and 7.75 kilograms of ANTAROX CA89™ were charged at room temperature. 3.60 Kilograms of ammonium persulfate, the initiator, were added to the aqueous phase in the reactor under nitrogen purge. The organic phase comprised of the monomers and a chain transfer agent was prepared in a 150 gallon vessel equipped with an agitator by mixing 288.9 kilograms of styrene, 72.2 kilograms of butyl acrylate, 5.40 kilograms of acrylic acid, 4.70 kilograms of dodecanethiol and 3.60 kilograms of carbon tetrabromide.

The organic phase was fed into the reactor over 20 minutes while maintaining the reactor at room temperature. At the conclusion of the organic phase monomer feed, the reactor was heated to the reaction temperature of 70° C. in a controlled fashion in 90 minutes, while maintaining the agitation at 70 rpm. The polymerization was continued for 95 minutes, after which the temperature was increased again and the composition was post-heated at 85° C. for 60 minutes, then cooled. The reactor system was deoxygenated by passing a stream of nitrogen through it during the reaction.

A latex containing about 42.5 percent solids with an $M_w$ of 33,900, an $M_n$ of 11,600 and an onset Tg of 58.1° C. was obtained. The residual monomer (styrene and butyl acrylate) in the latex was less than 100 ppm for each monomer. Sediment containing low $M_w$ and low Tg polymer of styrene/butylacrylate/acrylic acid particles was observed upon standing for two days. The amount of sediment determined by centrifugation at 3,000 G-force for 180 seconds was 4 percent of the total latex. The latex sediment was removed from the entire batch using a 14 inch diameter decanting centrifuge prior to future use in toner particle preparation.

Examples I and II illustrate the emulsion polymerization process with an anionic surfactant in which less than 20 percent of the surfactant was used in the preparation of the aqueous phase. Comparative Example 1 illustrates an emulsion polymerization process with more than 20 percent of an anionic surfactant system, while Comparative Example 2 illustrates an emulsion polymerization process using both an anionic and nonionic surfactant.

Toner particles of a nominal particle size of 5.5 microns were prepared from the latexes obtained in Example I and Comparative Examples 1 and 2 by aggregation/coalescence using the same conditions for aggregation, coalescence, washing and drying. The toner was comprised of the above resin or polymer, carbon black REGAL 330®, 6 percent particles contained black and 10 percent of POLYWAX 725™ wax. The aggregation/coalescence procedure involved the homogenization of the latex with deionized water using a high sheer homogenizer, followed by addition of a 30 percent aqueous wax dispersion (Polyethylene P725™ wax) and an aqueous carbon black dispersion (REGAL 330® carbon black) and continuing the homogenization. To the homogenized latex/pigment/wax blend a controlled amount of 10 percent solution of polyaluminum chloride and $HNO_3$ were added to cause flocculation. The creamy blend was heated in a reactor under agitation to about 55° C. to about 60° C. while particle growth was monitored. When the particle size reached over 5 microns (volume average diameter) additional latex was added (28 percent of total) to form a shell. The pH of the slurry was adjusted to 5.5 using 1 percent NaOH and the reactor temperature was increased to about 93° C. to about 95° C. After 6 hours at this temperature, the mixture was cooled down, the pH adjusted to 10, the particles filtered off, washed repeatedly with deionized water by reslurry washing and filtration, and dried.

The toner particle size (D50, volume average diameter) and particle size distribution (GSD volume and number) were measured on a Coulter Counter. The shape of the toner was shown to be spherical by electron scanning microscopy.

Developers were prepared using a 35 micron carrier with a ferrite core coated with a 1.25 weight percent polymethylmethacrylate coating containing carbon black. The developers were conditioned at 28° C., 85 percent relative humidity (A zone) and 100° C. and 15 percent relative humidity (C zone) and charged by mixing for 2 minutes. The toner tribo charge was determined using a Charge Spectrograph (CSG) at 100 volts per centimeter and expressed as displacement in millimeters from the zero dot position (zero field). The humidity and temperature sensitivity was reported as the ratio of tribo charge in the two zones (A/C).

As illustrated in Table 1, the toner particles obtained from the latex prepared according to the present invention (Example I) have a significantly higher tribo charge especially in A zone, and as a result a much lower sensitivity of the tribo charge to variations of humidity and temperature as illustrated by the high (0.79) A/C ratio.

TABLE 1

| Latex (Example) | Example I | Comparative Example 1 | Comparative Example 2 |
|---|---|---|---|
| Particle size (D50) Micron | 5.54 | 5.26 | 5.29 |
| Particle size distribution (volume) (GSDv) | 1.22 | 1.20 | 1.19 |

TABLE 1-continued

| Latex (Example) | Example I | Comparative Example 1 | Comparative Example 2 |
|---|---|---|---|
| Particle size distribution (number) (GSDn) | 1.25 | 1.21 | 1.20 |
| Tribo Charge A zone (mm) | −12.2 | −3.7 | −1.2 |
| Tribo Charge C zone (mm) | −16.2 | −11.8 | −4.2 |
| Tribo Charge Ratio A/C | 0.79 | 0.28 | 0.31 |

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for the preparation of toner comprising mixing an aqueous phase containing an anionic surfactant and an initiator with a monomer emulsion, and wherein an effective amount of said monomer emulsion is present; heating; mixing colorant with said formed latex polymer and coalescing.

2. A process in accordance with claim 1 wherein the process is free of nonionic surfactant.

3. A process in accordance with claim 1 wherein the anionic surfactant is a diphenyloxide disulfonate.

4. A process in accordance with claim 1 wherein said free radical initiator is added to the aqueous phase before, during or simultaneously with said monomer emulsion.

5. A process in accordance with claim 4 wherein said free radical initiator is contained in the monomer emulsion when it is added to the aqueous phase.

6. A process in accordance with claim 4 wherein said free radical initiator is added over a period of from about 5 to about 24 minutes.

7. A process in accordance with claim 1 wherein the free radical initiator contained in said aqueous phase during the seed polymerization is present in an amount of from about 5 to about 100 percent by weight.

8. A process in accordance with claim 1 wherein said free radical initiator is a persulfate initiator.

9. A process in accordance with claim 1 wherein said monomer emulsion further comprises a chain transfer agent.

10. A process in accordance with claim 1 wherein said surfactant in (i) is present in an amount present in an amount of from about 0.1 to about 3 percent of the total amount used in forming said latex, and said portion of said monomer emulsion added in (iii) is selected in an amount of about 0.5 to about 3 percent by weight of the monomer emulsion.

11. A process in accordance with claim 1 wherein about 0.1 to about 50 percent of the remainder of said monomer emulsion is added to (iv), and wherein said total amount of said monomer emulsion is about 100 percent.

12. A process in accordance with claim 1 wherein said monomers used to prepare an emulsion (I) comprise more than three monomers.

13. A process In accordance with claim 1 wherein said monomer emulsion in (ii) is selected in an amount of from about 80 to about 99 percent.

14. A process in accordance with claim 1 and wherein a toner is generated by aggregating a colorant with the formed latex polymer; and coalescing or fusing the aggregates to form toner particles.

15. A process in accordance with claim 14 wherein the colorant is a dispersion containing a surfactant.

16. A process in accordance with claim 14 further comprising adding a flocculent to the latex polymer before the latex polymer is aggregated with said colorant.

17. A process in accordance with claim 14 wherein said aggregates further comprise a wax.

18. A process in accordance with claim 14 wherein said aggregates further comprise a charge control agent.

19. A process in accordance with claim 14 wherein the colorant is a pigment.

20. A process in accordance with claim 14 wherein the colorant is a dye.

21. A process in accordance with claim 1 wherein said latex polymer is a methacrylate, an acrylate, a styrene methacrylate, or a styrene acrylate.

22. A process in accordance with claim 1 wherein said latex polymer is a styrene/butylacrylate/carboxyethylacrylate, optionally with from about 70 to about 80 weight percent of styrene, optionally about 30 percent of butylacrylate, and optionally about 1 to about 5 percent carboxyethylacrylate.

23. A process in accordance with claim 1 wherein heating is at a temperature of from about 70° C. to about 80° C.

24. A process in accordance with claim 1 wherein said anionic surfactant is present in an amount of from about 1 to about 10 weight percent, and said adding of (iii) of about 50 percent or less is from about 0.25 to about 30 weight percent, and said adding of said remaining (iv) is from about 75 to about 99 weight percent.

25. A process in accordance with claim 1, wherein said latex polymer is generated by (i) preparing or providing an aqueous phase containing an anionic surfactant;

(ii) preparing or providing a monomer emulsion in water which emulsion contains an anionic surfactant;

(iii) adding about 50 percent or less of said monomer emulsion to said aqueous phase to thereby initiate seed polymerization and to form a seed polymer, said aqueous phase further containing a free radical initiator; and (iv) adding the remaining amount of said monomer emulsion to (iii) and heating to complete an emulsion polymerization and wherein there is generated said polymer.

26. A process in accordance with claim 1, wherein said monomer emulsion is added in an amount of from about 0.25 to about 30 weight percent followed by the addition of from about 70 to about 99 weight percent of said monomer emulsion, and wherein the total of said monomer emulsion is about 100 percent by weight.

27. A process in accordance with claim 14 wherein said aggregating is accomplished by heating below about the glass transition temperature of said polymer, and wherein said coalescing is accomplished by heating about above said polymer glass transition temperature.

28. A process for the preparation of toner comprising mixing a colorant dispersion, an aqueous monomer emulsion, and an aqueous phase emulsion, and wherein the monomer and aqueous emulsion contains an anionic surfactant, wherein the anionic surfactant is optionally present in an amount of from about 70 to about 99 weight percent in the monomer emulsion, wherein the anionic surfactant is optionally present in an amount of from about 30 to about 1 weight percent in the aqueous emulsion and thereafter aggregating and coalescing by heating.

29. A process in accordance with claim 14 wherein said anionic surfactant is sodium dodecylsulfate (SDS), sodium dodecylbenzene sulfonate (SDBS), sodium dodecylnaphthalene sulfate, dialkyl benzenealkyl sulfates or sulfonates, abitic acid, or sodium tetrapropyl diphenyloxide disulfonate.

30. A process in accordance with claim 14 wherein said surfactant is DOWFAX 2A1 ™, a sodium tetrapropyl diphenyloxide disulfonate.

31. A process in accordance with claim 28 wherein a free radical initiator is added.

32. A process In accordance with claim 1 wherein the latex polymer is generated from the polymerization of monomer to provide a latex emulsion with submicron resin particles in the size range of from about 150 to about 300 nanometers in volume average diameter, and wherein the latex contains an Ionic surfactant, a water soluble initiator, a crosslinking agent and a chain transfer agent; adding anionic surfactant to retain the size of the toner aggregates formed; mixing with colorant; thereafter coalescing or fusing said aggregates by heating; and isolating, washing, and drying the toner.

33. A process in accordance with claim 14 wherein the aggregation temperature is from about 45° C. to about 55° C., and wherein the coalescence or fusion temperature is from about 85° C. to about 95° C.

34. A process in accordance with claim 1 wherein the latex resin, or polymer is selected from the group consisting of poly(styranealkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

35. A process in accordance with claim 14 wherein the latex polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein said colorant is a pigment.

36. A process in accordance with claim 2 wherein the colorant is carbon black, cyan, yellow, magenta, or mixtures thereof; the toner particles isolated are from about 2 to about 25 microns in volume average diameter, and wherein there is added to the surface of the formed toner metal salts, metal salts of fatty acids, silicas, metal oxides, or mixtures thereof, each in an amount of from about 0.1 to about 10 weight percent of the obtained toner particles.

37. A process In accordance with claim 1 wherein the free radical initiator is ammonium persulfate, potassium persulfate, sodium persulfate, ammonium persulfite, potassium persulfite, sodium persulfite, ammonium bisulfate, sodium bisulfate, 1,1'-azobis(1-methyl butyronitrile-3-sodium sulfonate), or 4,4'-azobis(4-cyanovaleric acid).

38. A process in accordance with claim 29 wherein said chain transfer agent is dodecanethiol, butanethiol, isooctyl-3-mercaptopropionate (IOMP), 2-methyl-5-t-butylthiophenol, carbon tetrachloride, or carbon tetrabromide.

39. A process in accordance with claim 29 wherein the aggregation temperature is from about 45° C. to about 55° C., and wherein the coalescence or fusion temperature is from about 85° C. to about 95° C.

40. A process in accordance with claim 39 wherein said aggregation and said coalescence are accomplished respectfully by heating below the glass transition temperature of said polymer and heating above the transition temperature of said polymer, followed by cooling.

41. A process in accordance with claim 1 wherein said aqueous phase surfactant is selected in an amount of from about 1 to about 20 weight percent.

* * * * *